US006182538B1

(12) United States Patent
Chen

(10) Patent No.: US 6,182,538 B1
(45) Date of Patent: Feb. 6, 2001

(54) SHANK STRUCTURE FOR A WRENCH

(76) Inventor: Ching Chen, No. 22, Nong 2, Lane 741, Dong-Ping Rd., Taiping City, Taichung Hsien (TW)

( * ) Notice: Under 35 U.S.C. 154(b), the term of this patent shall be extended for 0 days.

(21) Appl. No.: 09/460,042

(22) Filed: Dec. 13, 1999

(51) Int. Cl.[7] ..... B25B 23/16

(52) U.S. Cl. ..... 81/177.1; 81/489; 16/DIG. 12; 16/110 R; D7/393; D8/DIG. 7

(58) Field of Search ..... 81/177.1, 125.1, 81/427.5, 489; 30/340, 343, 164; 16/DIG. 12, 110 R; 15/143.1; D7/649, 393; D8/21, 28, 300, 321, DIG. 4, DIG. 5, DIG. 7

(56) References Cited

U.S. PATENT DOCUMENTS

| | | | | |
|---|---|---|---|---|
| D. 25,560 | * | 6/1896 | Smith | D7/649 |
| 4,091,497 | * | 5/1978 | Bade | 16/DIG. 12 X |
| 5,008,970 | * | 4/1991 | Tsai | 81/489 X |
| 5,475,894 | * | 12/1995 | Wildförster | 81/489 X |
| 6,108,870 | * | 8/2000 | Lo | 81/489 X |

* cited by examiner

*Primary Examiner*—D. S. Meislin
(74) *Attorney, Agent, or Firm*—Charles E. Baxley

(57) ABSTRACT

A wrench includes a shank having two ends and a plurality of recesses are respectively defined in two surfaces of the shank. Any two adjacent recesses in the first surface of the shank are divided by a first rib and any two adjacent recesses in the second surface of the shank are divided by a second rib. The first ribs and the second ribs are located crosswise so as to have better structural strength.

4 Claims, 6 Drawing Sheets

SHANK STRUCTURE FOR A WRENCH

FIELD OF THE INVENTION

The present invention relates to a wrench, and more particularly, to a shank structure of a wrench. The shank has a plurality of recesses defined in two surfaces thereof and any two adjacent recesses are divided by a rib so as to have a light weight and a strong structural strength.

BACKGROUND OF THE INVENTION

A conventional wrench 10 is shown in FIG. 1 and generally includes a shank 12 with an box end 11 and an open end 13. The shank 12 is made of solid metal so as to bear large torque when operating the wrench 10. However, such the solid shank 12 is heavy and is not convenient for the user to carry and/or operate. Generally, the user will carry a whole set of wrenches having plural of specifications so as to tighten or loosen different buts or bolts. The whole set of wrenches is so heavy that the applicant expects to develop a new and useful wrench that has light weight and the structural strength is properly maintained.

The present invention intends to provide a wrench having a shank with a plurality of recesses defined in two surfaces thereof and ribs are formed to divide recesses so as to maintain the strength of the shank of the wrench.

SUMMARY OF THE INVENTION

In accordance with one aspect of the present invention, there is provided a wrench comprising a shank having two ends. The shank includes a first surface and a second surface. A plurality of first recesses are defined in the first surface of the shank and divided by first ribs. A plurality of second recesses are defined in the second surface of the shank and divided by second ribs. The first ribs and the second ribs are located crosswise.

The object of the present invention is to provide a wrench wherein the shank has recesses defined in two surfaces thereof so that the whole weight of the wrench is reduced.

Another object of the present invention is to provide a light wrench wherein the recesses are divided by ribs wherein the ribs one the two surfaces of the shank are located crosswise.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
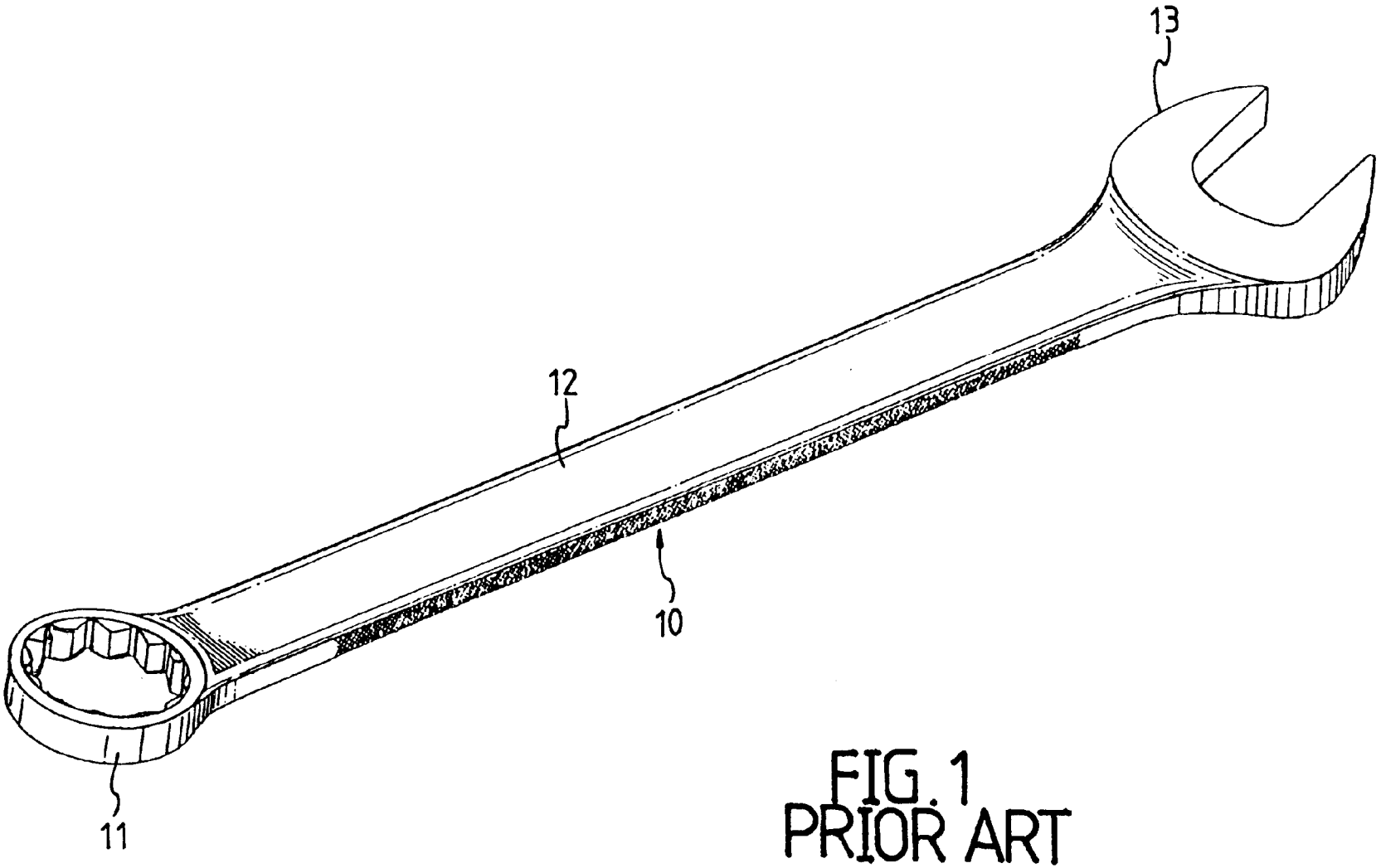
FIG. 1 PRIOR ART
FIG. 1 is a perspective view to show a conventional wrench.
Figure 2:
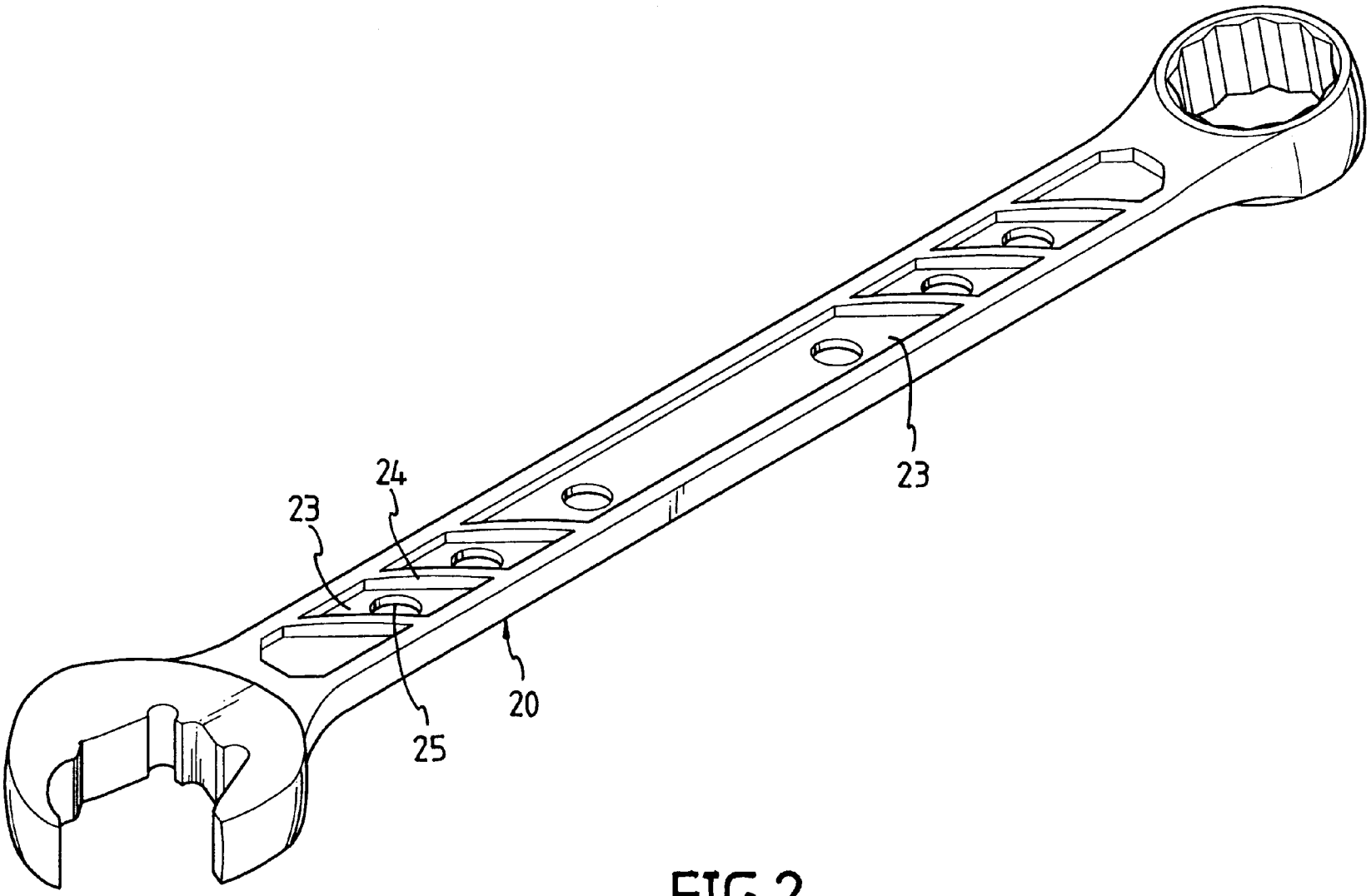
FIG. 2 is a perspective view to show a wrench in accordance with the present invention.
Figure 3:
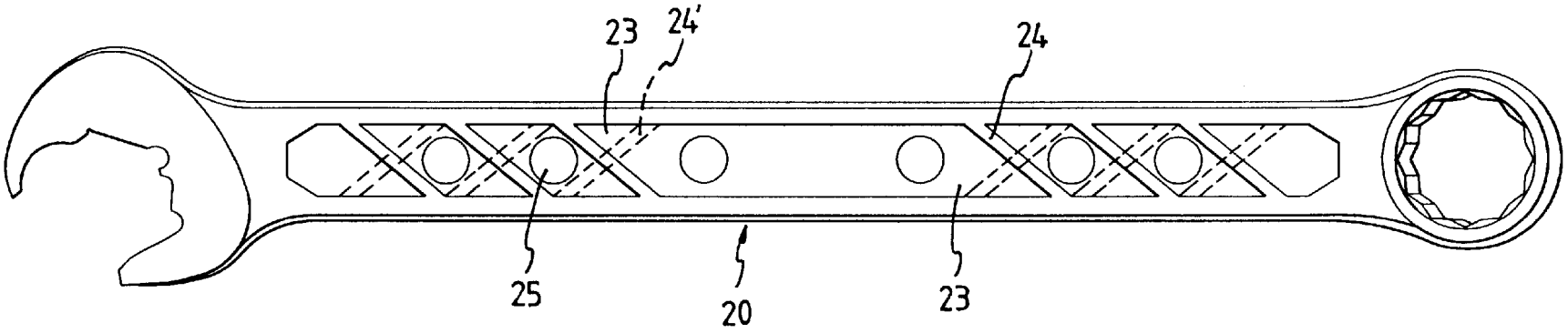
FIG. 3 is an illustrative view to illustrate the ribs on two surfaces of the shank are located crosswise.
Figure 4:
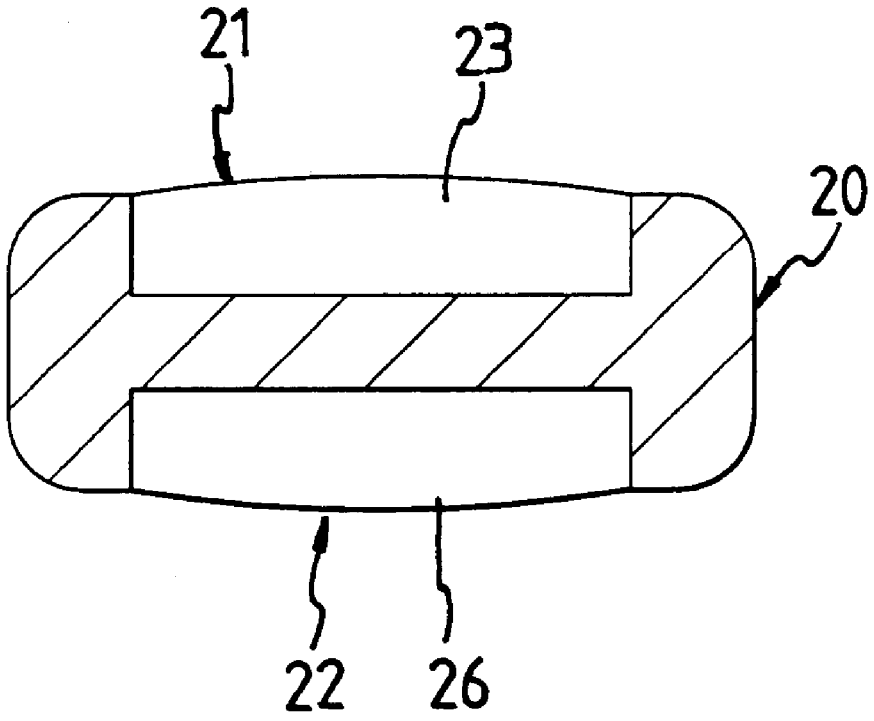
FIG. 4 is a cross-sectional view to show the shank of the wrench of the present invention.

Referring to FIGS. 2 to 4, the wrench in accordance with the present invention comprises a shank 20 having a box end and an open end. The shank 20 has a first surface 21 and a second surface 22 (see FIG. 4). A plurality of first recesses 23 are defined in the first surface 21 of the shank 20 and divided by first ribs 24. A plurality of second recesses 26 are defined in the second surface 22 of the shank 20 and divided by second ribs 24'. The first ribs 24 and the second ribs 24' are located crosswise so that when the wrench is used to bear a torque, the crossed first ribs 24 and second ribs 24' provide an expected structural strength for the shank 20.

A hole 25 is defined through selected one of the first recesses 23 and the second recesses 26 to further reduce the weight of the wrench. The holes 25 are advantageous to let a rod pass through the holes 25 to hanged them on a wall if the wrenches each have two open ends.

Figure 5:
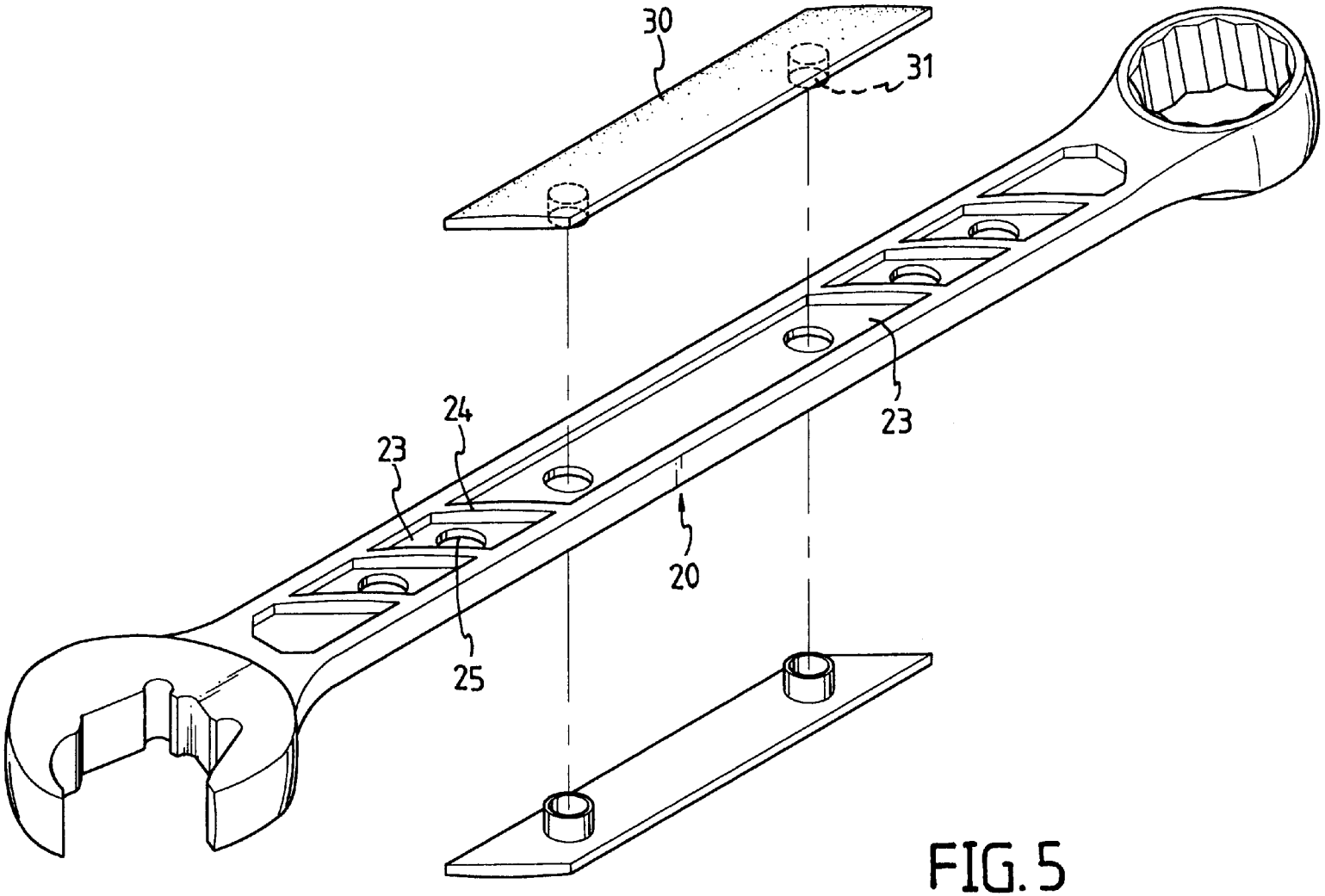
FIG. 5 is an exploded view to show two pad members and the wrench of the present invention.
Figure 6:
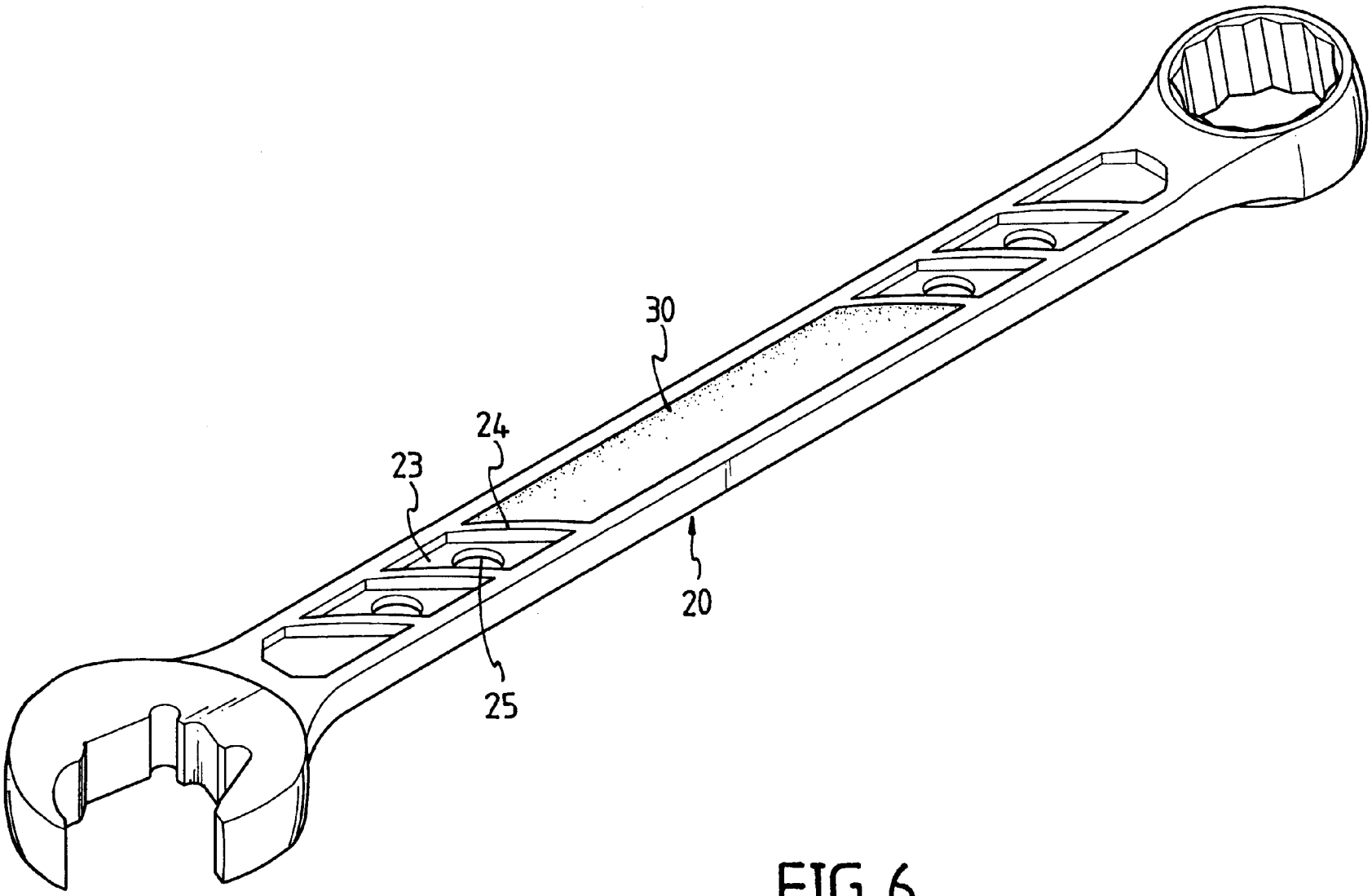
FIG. 6 is a perspective view to show the wrench in accordance with the present invention with two pad members attached thereto.

As shown in FIGS. 5 and 6, two pad members 30 made of soft and durable material can be attached to the first surface 21 and the second surface 22 of the shank 20 so that the user can hold the shank 20 firmly. The pad members 30 are engaged with the first recesses 23 and the second recess 26 by glue or other known manners. As shown in FIG. 5, each pad member 30 has two protrusions 31 extending from one of two surfaces thereof and the protrusions 31 are engaged with the holes 25 defined through the first recess 23 and the second recess 26.

The width of the ribs 24 and 24' and the position that the crossed ribs 24 and 24' can be calculated so as to have the maximum strength while the weight of the wrench is light.

While we have shown and described various embodiments in accordance with the present invention, it should be clear to those skilled in the art that further embodiments may be made without departing from the scope and spirit of the present invention.

What is claimed is:

1. A wrench comprising:

a shank having two ends, said shank having a first surface and a second surface, a plurality of first recesses defined in said first surface of said shank and divided by first ribs, a plurality of second recesses defined in said second surface of said shank and divided by second ribs, said first ribs and said second ribs located crosswise.

2. The wrench as claimed in claim 1, wherein said at least one hole defined through one of said first recesses and said second recesses.

3. The wrench as claimed in claim 2, wherein at least one pad member is engaged with one of said first recesses, at least one protrusion extending from one of two surfaces of said at least one pad member and said at least one protrusion engaged with said at least one hole.

4. The wrench as claimed in claim 1 further comprising at least one pad member engaged with one of said first recesses.

* * * * *